US012173599B1

(12) United States Patent
Jiao et al.

(10) Patent No.: US 12,173,599 B1
(45) Date of Patent: Dec. 24, 2024

(54) INTERNAL PEEPING DETECTION-WHILE-DRILLING SYSTEM AND METHOD FOR DEEP GOAF OF MINING-DISTURBED STRATUM

(71) Applicants: CHINA UNIVERSITY OF GEOSCIENCES (WUHAN), Wuhan (CN); Institute of Rock and Soil Mechanics, Chinese Academy of Sciences, Wuhan (CN)

(72) Inventors: Yuyong Jiao, Wuhan (CN); Xuefeng Yan, Wuhan (CN); Yule Hu, Wuhan (CN); Zengqiang Han, Wuhan (CN); Yiteng Wang, Wuhan (CN); Luyi Shen, Wuhan (CN); Junpeng Zou, Wuhan (CN); Fei Zheng, Wuhan (CN); Peng Zhang, Wuhan (CN)

(73) Assignees: CHINA UNIVERSITY OF GEOSCIENCES (WUHAN), Wuhan (CN); Institute of Rock and Soil Mechanics, Chinese Academy of Sciences, Wuhan (CN)

( * ) Notice: Subject to any disclaimer, the term of this patent is extended or adjusted under 35 U.S.C. 154(b) by 0 days.

(21) Appl. No.: 18/399,759

(22) Filed: Dec. 29, 2023

(30) Foreign Application Priority Data

Jul. 10, 2023 (CN) ..... 202310845177.0

(51) Int. Cl.
*E21B 47/013* (2012.01)
*E21B 44/00* (2006.01)
(Continued)

(52) U.S. Cl.
CPC ..... *E21B 47/0025* (2020.05); *E21B 44/005* (2013.01); *E21B 47/13* (2020.05); *E21B 17/073* (2013.01); *E21B 47/013* (2020.05)

(58) Field of Classification Search
CPC .... E21B 47/0025; E21B 47/13; E21B 47/013; E21B 44/005; E21B 17/073
See application file for complete search history.

(56) References Cited

U.S. PATENT DOCUMENTS 7,113,092 B2 9/2006 Keene
7,397,892 B2 7/2008 Linev
(Continued)

*Primary Examiner* — Krystine E Breier
(74) *Attorney, Agent, or Firm* — True Shepherd LLC; Andrew C. Cheng

(57) ABSTRACT

An internal peeping detection-while-drilling system includes an intelligent probing rod, cable drill pipes, a signal relay sub, a ground control terminal, a data interpretation and goaf reconstruction imaging software system, and a remote data transmission system, where the intelligent probing rod includes an up-down separated protective transmission mechanism and an instrument cabin; the intelligent probing rod includes a lower end connected to a drilling bit, and an upper end connected to each of the cable drill pipes; the instrument cabin is provided in the up-down separated protective transmission mechanism, and provided with a sonar-lidar-audio/video sensor assembly; the cable drill pipes are connected to each other to form a cable and data transmission channel; the signal relay sub is provided between the cable drill pipes at intervals; and an uppermost end of the cable drill pipe is connected to the ground control terminal.

7 Claims, 8 Drawing Sheets

(51) Int. Cl.

| | |
|---|---|
| ***E21B 47/002*** | (2012.01) |
| ***E21B 47/13*** | (2012.01) |
| *E21B 17/07* | (2006.01) |

(56) References Cited

U.S. PATENT DOCUMENTS

| | | | | |
|---|---|---|---|---|
| 10,344,590 | B1 * | 7/2019 | Young | E21B 33/1208 |
| 10,386,249 | B2 | 8/2019 | Zaripov et al. | |
| 2018/0374607 | A1 * | 12/2018 | Hernandez Marti | H01B 7/18 |
| 2020/0224524 | A1 * | 7/2020 | Parmeshwar | E21B 47/09 |
| 2020/0291767 | A1 * | 9/2020 | Kroslid | G06F 17/18 |

* cited by examiner

INTERNAL PEEPING DETECTION-WHILE-DRILLING SYSTEM AND METHOD FOR DEEP GOAF OF MINING-DISTURBED STRATUM

CROSS-REFERENCE TO RELATED APPLICATIONS

This application claims priority to Chinese Patent Application No. 202310845177.0 with a filing date of Jul. 10, 2023. The content of the aforementioned application, including any intervening amendments thereto, is incorporated herein by reference.

TECHNICAL FIELD

The present disclosure relates to the technical field of stratum detection, and in particular to an internal peeping detection-while-drilling system and method for a deep goaf of a mining-disturbed stratum.

BACKGROUND

Peep imaging for an underground goaf is implemented by either allowing a surveyor with a detecting instrument to directly enter an underground space for detection, or by sending the instrument to the goaf via a drilled borehole for detection. However, the caving goaf of a deep coal mine and the underground goaf of a downhole rescue site have the following characteristics: (1) The maximum buried depth of the goaf is up to thousands of meters. (2) The overlying stratum on the goaf has experienced violent mining disturbance, and a stable drilling channel is not formed easily. (3) The surveyor cannot directly enter the underground goaf. (4) The goaf is random. (5) The target goaf has a complex internal structure and a poor visual condition.

For deep coal mining, both a caving goaf behind a working face and a rescue site of a downhole accident cannot be directly accessed. Due to violent mining-disturbed damage of the overlying rock stratum on the target goaf, ground borehole drilling is unattainable, an effective detecting channel cannot be formed, and the detecting instrument is sent to the target goaf hardly. In addition, for emergency rescues with limited time and heavy tasks, if borehole drilling and detection are performed respectively, the efficiency is low and the accident handling requirements cannot be met.

SUMMARY OF PRESENT INVENTION

In view of this, the present disclosure provides an internal peeping detection-while-drilling system for a deep goaf of a mining-disturbed stratum, including an intelligent probing rod, cable drill pipes, a signal relay sub, a ground control terminal, a data interpretation and goaf reconstruction imaging software system, and a remote data transmission system, where the cable drill pipes are connected to each other from an upper end of the intelligent probing rod to a ground drilling rig to form cable drill pipe assemblies; the cable drill pipe assemblies and the intelligent probing rod are connected sequentially from top to bottom to form a drill pipe assembly; an end of an uppermost cable drill pipe is connected to the ground drilling rig; and a lower end of the intelligent probing rod is connected to a drilling bit;

the intelligent probing rod includes an up-down separated protective transmission mechanism and an instrument cabin;

the up-down separated protective transmission mechanism includes a lower end connected to the drilling bit, and an upper end connected to the cable drill pipe;

the instrument cabin is provided in the up-down separated protective transmission mechanism; and the up-down separated protective transmission mechanism is configured to protect the internal instrument cabin in drilling, and extended out to expose the internal instrument cabin after entering a target goaf, so as to facilitate detection of the instrument cabin on the target goaf;

a sensor assembly including a sonar sensor, a lidar sensor and an audio and video sensor is provided in the instrument cabin; and the sensor assembly is configured to acquire structural parameters of the underground goaf, photograph the underground goaf and perform borehole-ground communication in an emergency rescue;

the signal relay sub is a special cable drill pipe, and is provided between the cable drill pipe assemblies at a certain spacing distance; the signal relay sub includes a signal relay and a relay cable; the relay cable includes an upper end and a lower end respectively connected to adjacent ones of the cable drill pipes, and a middle connected to the signal relay; and the signal relay receives a power carrier signal of a transmission cable in the lower cable drill pipe, performs demodulation, preprocessing, gain amplification, denoising, storage and modulation on the power carrier signal, and transmits relay processed data upward to the upper cable drill pipe in a form of a power carrier;

the cable drill pipes are connected to each other to form a power and data transmission channel; the cable drill pipe includes a lower end connected to the intelligent probing rod, and the upper end connected to the drilling rig; a transmission cable is provided in the cable drill pipe; the transmission cable is connected to the ground control terminal; the transmission cable is configured to transmit acquired data of the sensor assembly to the ground control terminal in the form of the power carrier; and the ground control terminal is configured to perform three-dimensional (3D) modeling on the acquired data of the sensor assembly through the data interpretation and goaf reconstruction imaging software system, thereby obtaining a 3D structural model of the underground goaf; and the remote data transmission system is connected to the ground control terminal, and configured to remotely transmit site detection data to a cloud server and a remote client, such that the site data is read and analyzed by a worker at the cloud server and the remote client to realize remote data management and communication information interaction.

Further, the up-down separated protective transmission mechanism includes a separable upper protective tube and lower protective tube; the instrument cabin is provided between the upper protective tube and the lower protective tube; an independent rotation control mechanism is provided in the upper protective tube; the independent rotation control mechanism is connected to the instrument cabin; and the independent rotation control mechanism is configured to drive the instrument cabin to rotate, such that the sensor assembly in the instrument cabin detects the underground goaf rotatably to obtain structural data of the underground goaf.

Further, the instrument cabin includes an instrument cabin rod body; a mounting hole is formed in a sidewall of the instrument cabin rod body; the sensor assembly is embedded into the mounting hole of the instrument cabin rod body; and a protective glass cover plate is further provided on the mounting hole.

Further, the independent rotation control mechanism includes three step control motors; the three step control motors are fixed in the upper protective tube; a driven tooth is provided at an end of the instrument cabin rod body; an end of each of the step control motors is engaged with the driven tooth through a gear; and the three step control motors rotate synchronously, thereby driving the instrument cabin to rotate.

Further, the ground control terminal includes a ground modem and an industrial notebook computer that are connected sequentially; and the ground modem is connected to the cable drill pipe through a cable, and configured to demodulate a signal transmitted from the sensor assembly to the ground control terminal; the data interpretation and goaf reconstruction imaging software system is built in the industrial notebook computer; and the industrial notebook computer is configured to extract a signal demodulated by the ground modem and perform modeling on the demodulated signal through the data interpretation and goaf reconstruction imaging software system, thereby obtaining the 3D structural model of the underground goaf.

Further, the internal peeping detection-while-drilling system further includes an Internet access device, the cloud server, a remote server, and a remote client; the Internet access device is connected to the ground control terminal, and configured to receive a signal from the ground control terminal, and transmit data to the cloud server; the remote server is configured to download data in real time from the cloud server, and store the data locally; and the remote client is configured to access the remote server, and read and analyze data, thereby realizing data updating and historical data playback.

Further, the cable drill pipe includes a plurality of sections; the signal relay sub is provided between the cable drill pipes; the signal relay and the relay cable are provided in the signal relay sub; the relay cable is connected to the transmission cable in the cable drill pipe; and the signal relay is configured to receive the carrier signal from the lower cable drill pipe, perform the demodulation, the data preprocessing, the gain amplification and the modulation on the carrier signal, and transmit processed data to the upper cable drill pipe.

The present disclosure further provides an internal peeping detection-while-drilling method for a deep goaf of a mining-disturbed stratum, which uses the internal peeping detection-while-drilling system for the deep goaf of the mining-disturbed stratum, and includes the following steps:

S1: mined-disturbed stratum drilling: allowing the drill pipe assembly including the cable drill pipes and the intelligent probing rod to drill to the target goaf;

S2: target goaf detection: extending out the intelligent probing rod to expose the instrument cabin after the intelligent probing rod reaches the goaf, and rotating the instrument cabin, where the sensor assembly in the intelligent probing rod performs all-round detection on the target goaf to acquire detection data;

S3: detection data transmission: modulating, by the sensor assembly after acquiring the detection data, the detection data, and transmitting the detection data to the ground through the cable drill pipe in the form of the power carrier, where the signal relay sub is provided at the certain spacing distance in the transmission channel formed by the cable drill pipes; the signal relay sub performs demodulation, preprocessing, gain amplification and remodulation on the modulated detection data, and transmits remodulated detection data to an upper end continuously; and at last, the detection data is transmitted to the ground control terminal through the cable drill pipe and the signal relay sub;

S4: underground goaf reconstruction imaging: demodulating, by the ground control terminal, acquired data, and performing modeling to obtain the 3D structural model of the underground goaf, thereby realizing detection analysis on a structural form of the underground goad and mine-ground rescue communication;

S5: remote Internet data transmission: transmitting, by the ground control terminal, site detection data to the cloud server through the Internet data transmission system; downloading, by the remote server, data of the cloud server; and accessing, by the remote client, the remote server to realize the remote data management and the communication information interaction; and S6: goaf form evaluation and emergency rescue: evaluating a form, an environment and a roof structure of the goaf through the underground goaf reconstruction and imaging in step S4; and realizing life detection on the underground goaf of the rescue site, and ground-underground real-time communication through step S5.

The present disclosure has the following beneficial effects: The instrument cabin with various sensors is provided on the intelligent probing rod. The internal peeping detection-while-drilling system is a combination of "drilling" and "peeping". The detection-while-drilling technology resolves problems of difficult downhole formation and protection of the deep mining-disturbed stratum and a low efficiency caused by separated drilling and detection, improves a detection efficiency on the underground goaf, and facilitates the underground rescue. Through the instrument cabin integrated with the various sensors, the internal peeping detection-while-drilling system overcomes limitations of complex environmental conditions on the detection technology, can visualize the underground goaf site in real time, and realizes underground-ground bidirectional voice communication of the rescue site. With a pipe-following drilling technology and a protective sealing device of the intelligent probing rod, the present disclosure resolves problems of hard drilling, hard hole formation, hard hole protection, and hard instrument protection in the deep mining-disturbed stratum, and has desirable reliability and adaptability. The internal peeping detection-while-drilling system is provided behind the drilling bit of the universal drilling rig, and enters the target goaf with the pipe-following drilling technology, thereby realizing the drilling and detection integrated internal peeing operation. With laser scanning and sonar operation, the present disclosure reconstructs and images an internal structure of the underground goaf, and improves a detection accuracy on the underground goaf.

Figure 1:
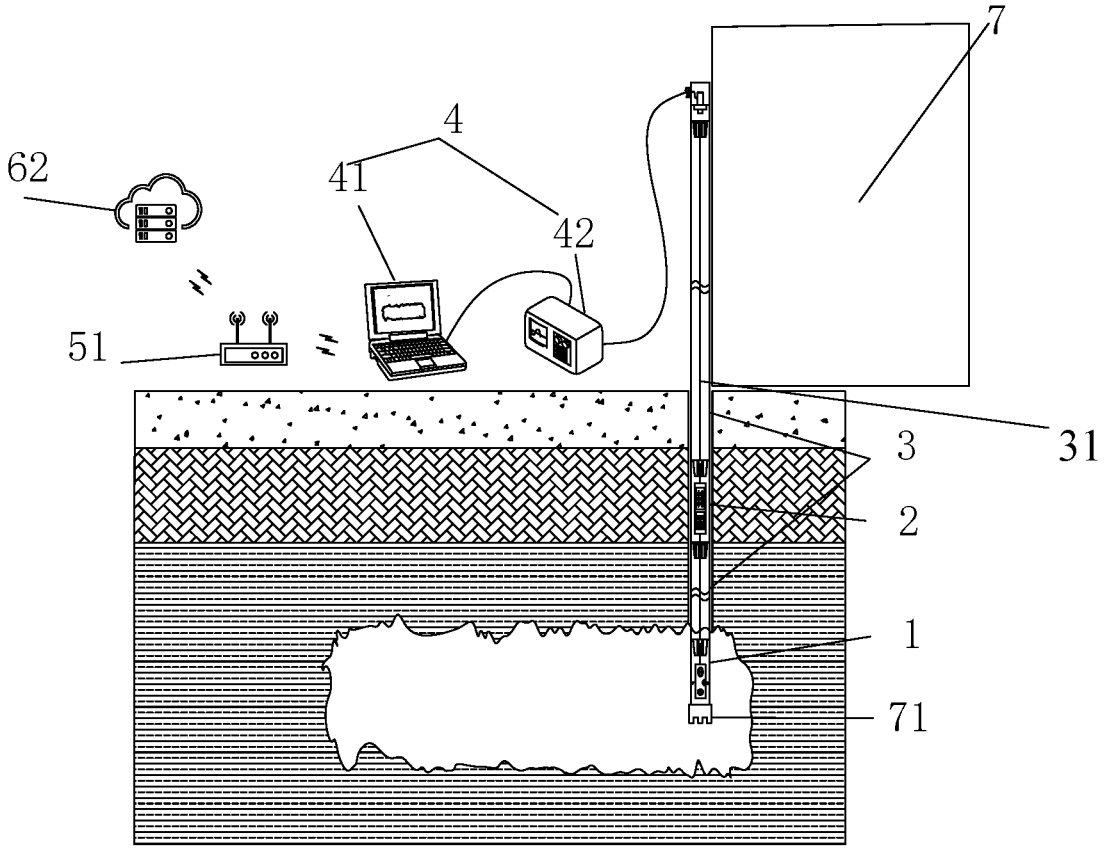
FIG. 1 is an overall structural view of an internal peeping detection-while-drilling system for a deep goaf of a mining-disturbed stratum according to the present disclosure.
Figure 2:
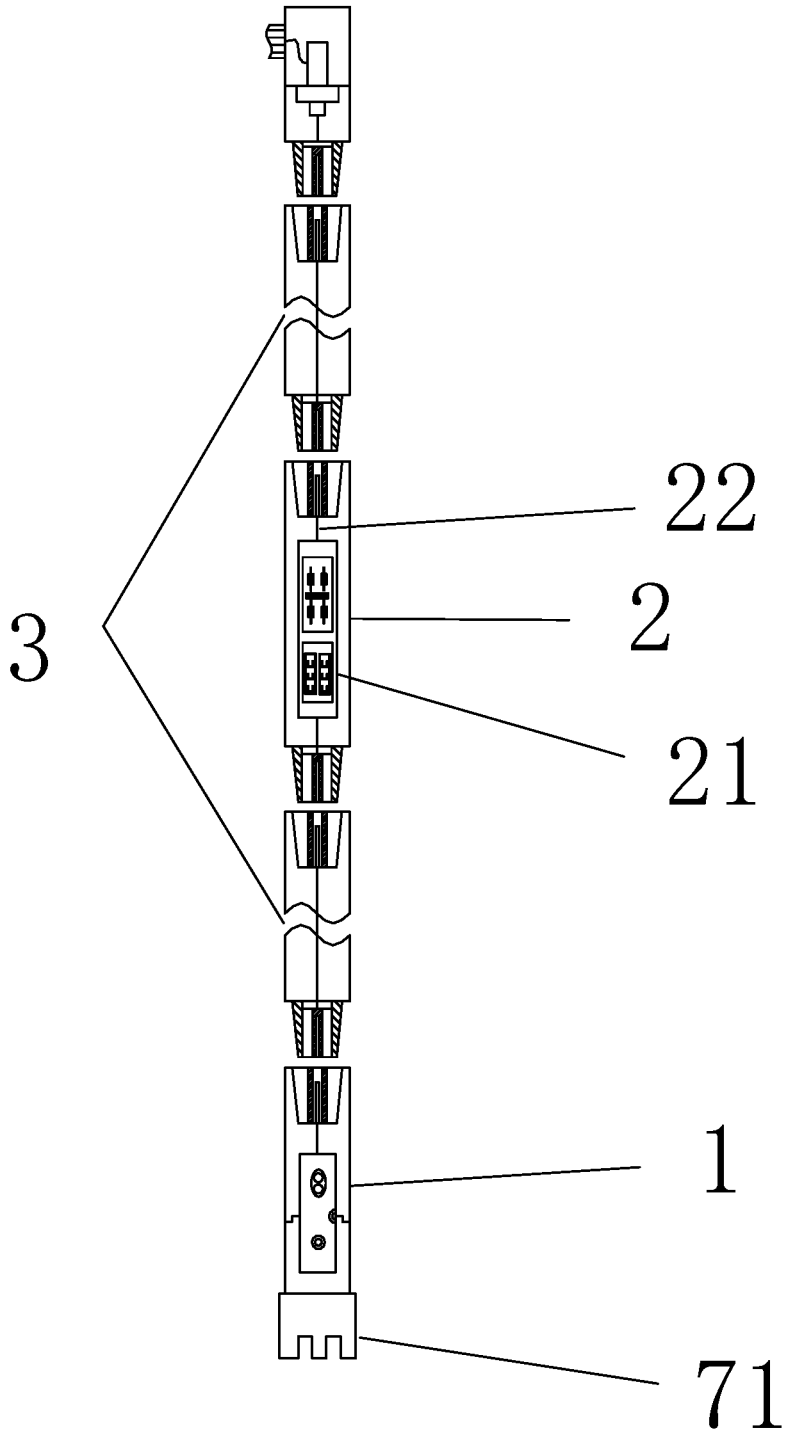
FIG. 2 is a schematic structural view of a data transmission portion in FIG. 1.

In the figures: 1—intelligent probing rod, 11—up-down separated protective transmission mechanism, 111—upper protective tube, 112—lower protective tube, 12—instrument cabin, 121—instrument cabin rod body, 1211—mounting hole, 122—circuit cabin cover plate, 123—sensor assembly, 1231—sonar sensor, 1232—lidar sensor, 1233—audio and video sensor, 124—master control circuit board, 125—downhole modem, 13—independent rotation control mechanism of instrument cabin, 131—step control motor, 132—transmission mechanism, 1321—driven tooth, 1322—driving gear, 14—sealing damped protection mechanism of instrument cabin, 141—multi-stage seal ring, 142—sliding oil seal connector, 143—housing seal, 144—instrument cabin control mainboard seal, 145—damping spring assembly, 2—signal relay sub, 21—signal relay, 22—relay cable, 3—cable drill pipe, 31—transmission cable, 4—ground control terminal, 41—industrial notebook computer, 42—ground modem, 5—cloud server, 51—Internet access device, 6—remote data transmission system, 61—remote server, 62—remote client, 621—remote data management module, 622—communication information interactive platform, 7—ground drilling rig, 71—drilling bit, 8—data interpretation and goaf reconstruction imaging software system, 81—intelligent probing rod built-in acquisition and control application module, 82—platform controller built-in application module, 83—ground industrial control system, and 84—a reconstruction imaging software platform.

DETAILED DESCRIPTION OF THE EMBODIMENTS

In order to make the objective, technical solution and advantages of the present disclosure clearer, implementations of the present disclosure will be further described in detail in conjunction with the accompanying drawings.

Referring to FIG. 1 to FIG. 6, the present disclosure provides an internal peeping detection-while-drilling system for a deep goaf of a mining-disturbed stratum, including an intelligent probing rod 1, a signal relay sub 2, cable drill pipes 3, a ground control terminal 4, a data interpretation and goaf reconstruction imaging software system 8, and a remote data transmission system 6.

There are a plurality of cable drill pipes 3. The plurality of cable drill pipes 3 are connected to each other from an upper end of the intelligent probing rod 1 to a ground drilling rig 7 to form cable drill pipe assemblies. The cable drill pipe assemblies and the intelligent probing rod 1 are connected sequentially from top to bottom to form a drill pipe assembly. The signal relay sub 2 is connected between the plurality of cable drill pipes 3. An end of the uppermost cable drill pipe 3 is connected to the ground drilling rig 7. The cable drill pipes 3 are connected to each other to form a power and data transmission channel. The cable drill pipe includes a lower end connected to the intelligent probing rod 1, and the upper end connected to the ground drilling rig 7. A transmission cable 31 is provided in the cable drill pipe. The transmission cable 31 is connected to the ground control terminal 4.

A lower end of the intelligent probing rod 1 is connected to a drilling bit 71. The intelligent probing rod 1 includes an up-down separated protective transmission mechanism 11, an instrument cabin 12, an independent rotation control mechanism 13 of the instrument cabin, and a sealing damped protection mechanism 14 of the instrument cabin.

The up-down separated protective transmission mechanism 11 includes a lower end connected to the drilling bit 71, and an upper end connected to the cable drill pipe 3. The instrument cabin 12 is provided in the up-down separated protective transmission mechanism 11. The up-down separated protective transmission mechanism 11 protects the instrument cabin 12, and transmits a torque to the drilling bit 71 in drilling. After the lower end of the up-down separated protective transmission mechanism 11 drills to a target goaf, an upper protective tube and a lower protective tube of the up-down separated protective transmission mechanism slide apart, such that the instrument cabin 12 is exposed out to detect the target goaf.

Figure 3:
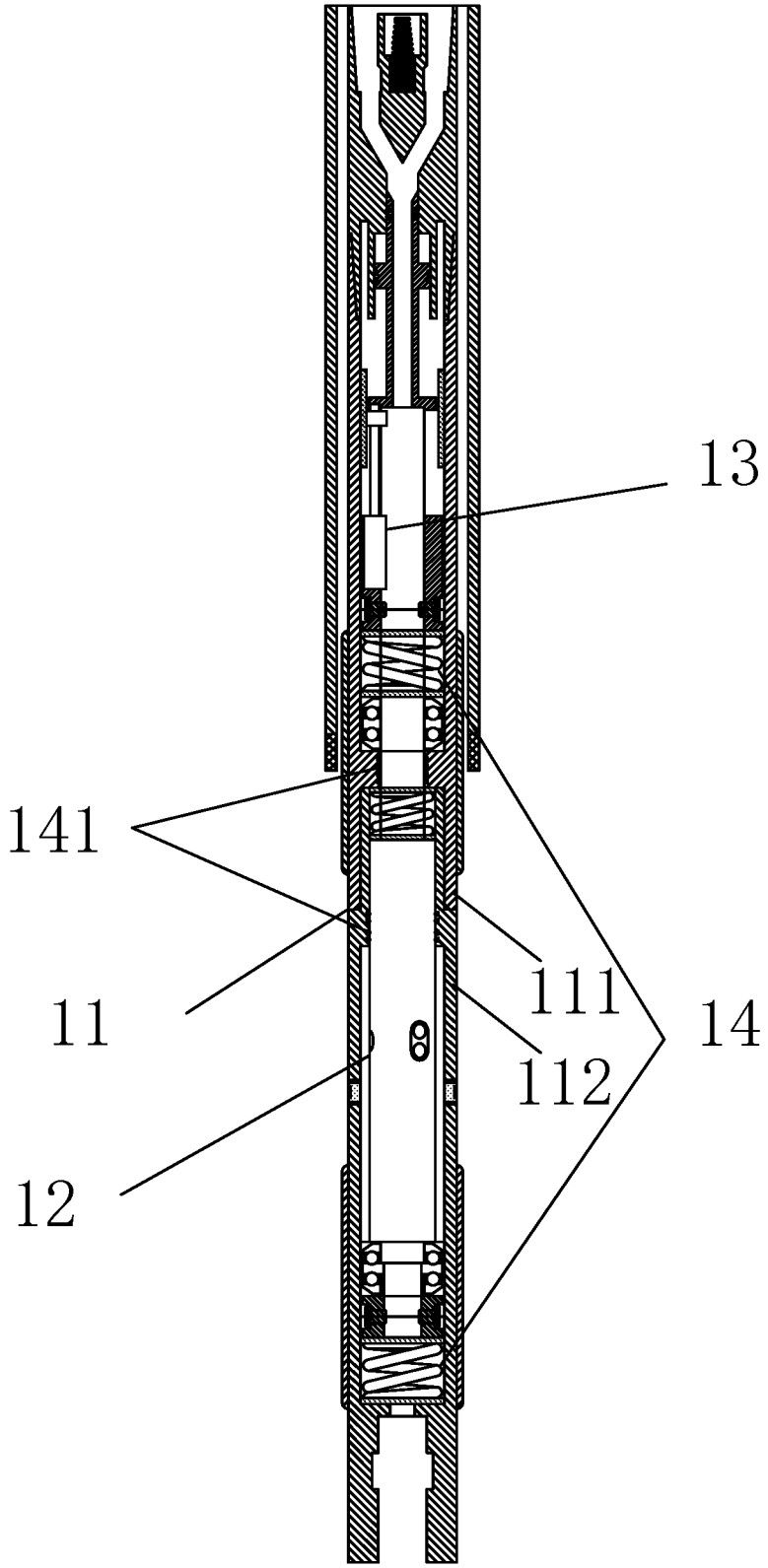
FIG. 3 is a schematic structural view of an intelligent probing rod.
Figure 4:
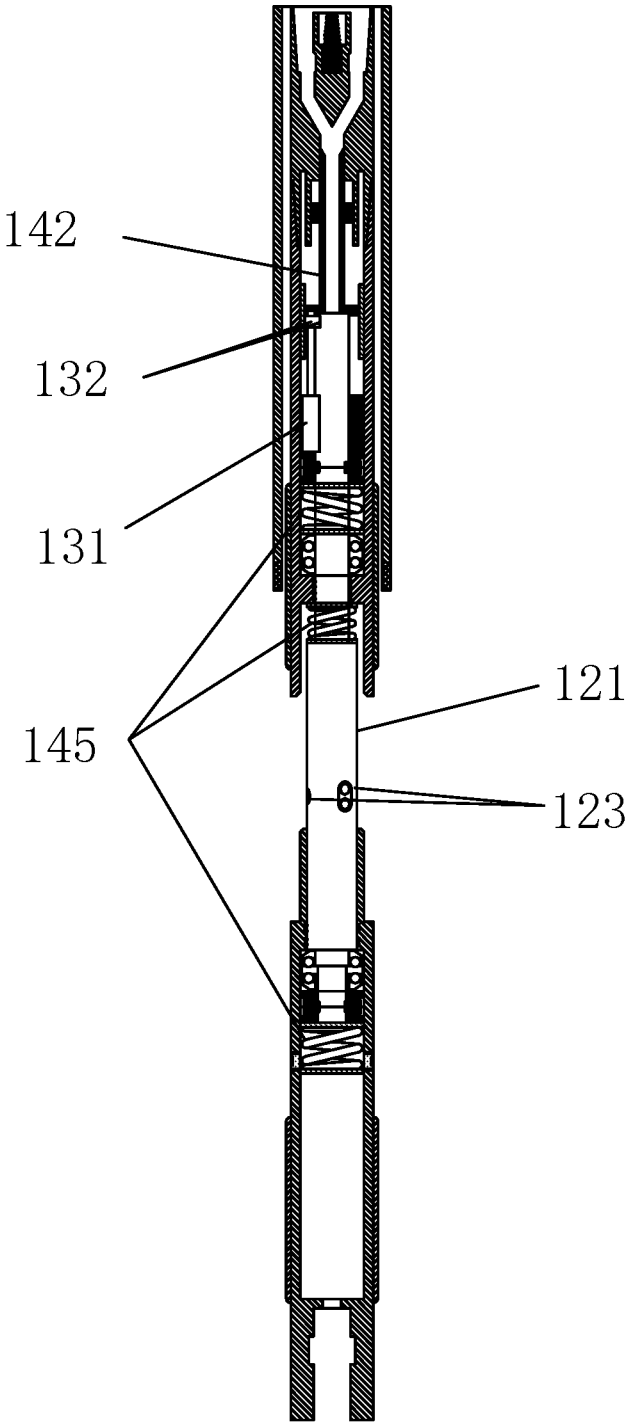
FIG. 4 is a schematic structural view of an instrument cabin of an intelligent probing rod.
Figure 5:
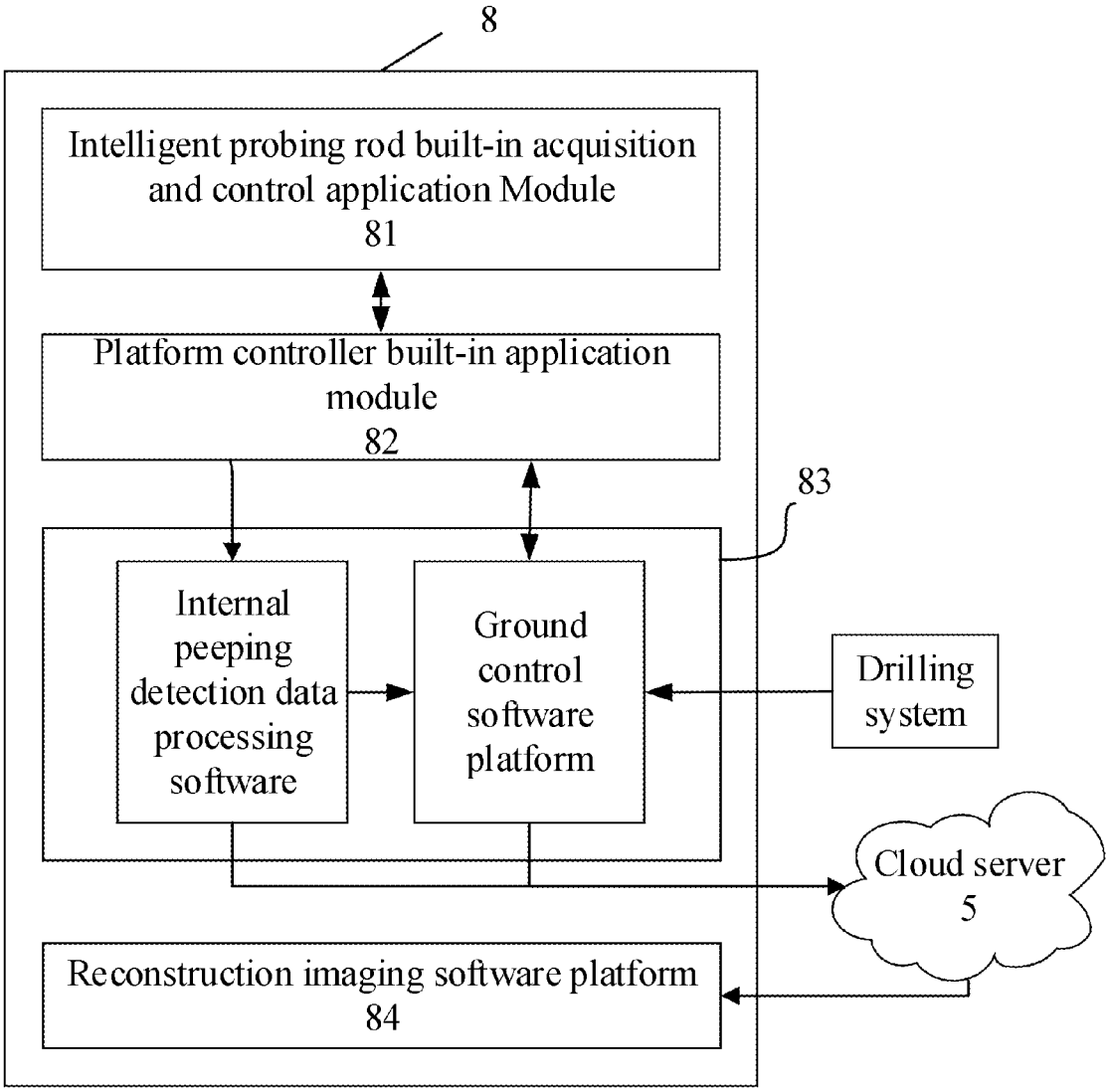
FIG. 5 is a schematic diagram showing a data interpretation and goaf reconstruction imaging software system.
Figure 7:
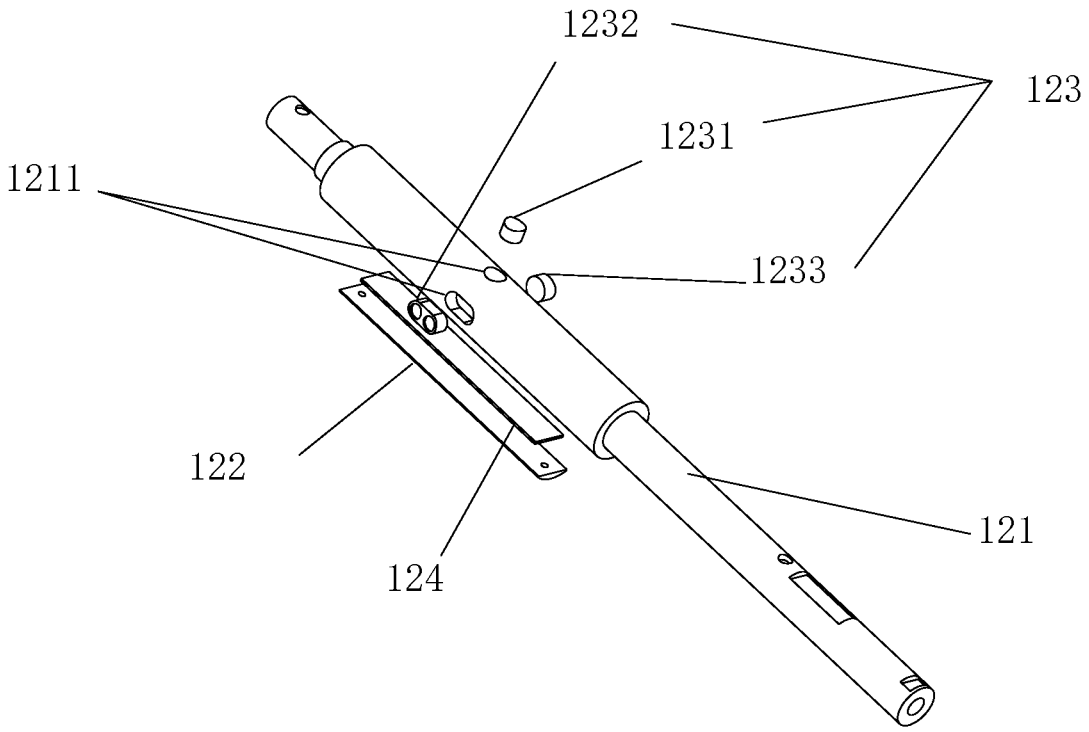
FIG. 7 is a schematic structural view of an instrument cabin.

Specifically, as shown in FIG. 3 and FIG. 7, the up-down separated protective transmission mechanism 11 comprises an upper protective tube 111 and a lower protective tube 112, and the instrument cabin 12 is arranged between the upper and lower protective tubes 111 and 113. The instrument cabin 12 includes an instrument cabin rod body 121, a circuit cabin cover plate 122, a sensor assembly 123, a master control circuit board 124, a downhole modem 125, and other functional devices. The sensor assembly 123 is embedded into a mounting hole 1211 in an outer wall of the instrument cabin rod body 121 in a certain arrangement manner. A protective glass cover plate is provided outside the mounting hole 1211. The sensor assembly 123 includes a sonar sensor 1231, a lidar sensor 1232, and an audio and video sensor 1233. With a comprehensive sonar-lidar-audio/video method, the sensor assembly 123 realizes real-time high-definition image observation, thermal infrared imaging and sonar imaging functions on the target goaf. With the audio bidirectional sensor, the detection system can perform bidirectional voice communication with a trapped person in the target goaf in an underground rescue.

The master control circuit board 124 is built in the instrument cabin rod body 121. The circuit cabin cover plate 122 covers the master control circuit board 124 in a sealing manner. The downhole modem 125 is provided on the master control circuit board 124, and configured to transmit detection data of the sensor assembly to the ground control terminal 4 through the cable in the cable drill pipe in a form of a power carrier in work.

Figure 8:
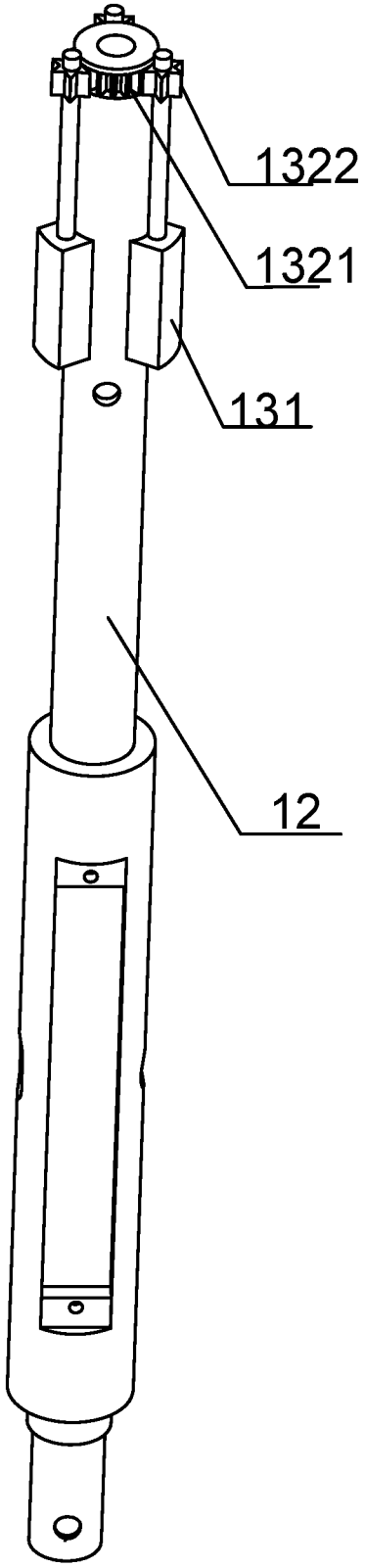
FIG. 8 is a schematic structural view showing a transimission mechanism.

As shown in FIG. 3 and FIG. 8, the independent rotation control mechanism 13 of the instrument cabin includes three step control motors 131 and the transmission mechanism 132. The step control motors 131, are fixed in the upper protection tube 111 of the up-down separated protective transmission mechanism 11, connected with an outer wall of the instrument cabin 12 through the transmission mechanism 132, and configured to control the instrument cabin 12 to rotate independently and stably in detection. The transmission mechanism 132 comprises a driven tooth 1321 arranged on the instrument compartment and a driving gear 1322 at one end of each stepper control motor. The instrument cabin rotates at 360°, and the sensor assembly 123 can perform all-round detection on the underground goaf, thereby improving a detection comprehensiveness and a detection accuracy on the underground goaf.

The sealing damped protection mechanism 14 of the instrument cabin includes multi-stage seal rings 141 between the upper protective tube and the instrument cabin as well as between the lower protective tube and the instrument cabin, a sliding oil seal connector 142 between the instrument cabin and a joint of the cable drill pipe, a sensor lens and housing seal 143, an instrument cabin control mainboard seal 144, and a damping spring assembly 145.

The cable drill pipes 3 are connected to each other to form the power and data transmission channel. The cable drill pipe includes the lower end connected to the intelligent probing rod, and the upper end connected to the ground drilling rig 7. The transmission cable 31 is provided in the cable drill pipe. The transmission cable 31 is connected to the ground control terminal 4.

The signal relay sub 2 is a special cable drill pipe, and is provided between the cable drill pipe assemblies at a certain spacing distance. The signal relay sub 2 includes a signal relay 21 and a relay cable 22. The relay cable 22 includes an upper end and a lower end respectively connected to adjacent ones of the cable drill pipes, and a middle connected to the signal relay. The signal relay receives a power carrier signal from the transmission cable of the lower cable drill pipe, performs demodulation, preprocessing, gain amplification, denoising, storage and modulation on the power carrier signal, and transmits the power carrier signal upward to the upper cable drill pipe in the form of the power carrier. The signal relay sub realizes the signal gain and signal fidelity, and increases a transmission distance of the signal. The cable drill pipe 3 is a center cable structure (the transmission cable for transmitting the signal and the power is provided in the cable drill pipe 3). The cable drill pipes are connected to each other to form the power and data transmission channel. The cable drill pipe includes the lower end connected to the intelligent probing rod, and the upper end connected to the drilling rig. The transmission cable is provided in the cable drill pipe. The transmission cable 31 is connected to the ground control terminal 4.

The ground control terminal 4 includes a ground modem 42 for signal conversion and an industrial notebook computer 41. The ground modem 42 is connected to the transmission cable in the cable drill pipe 3 through a cable, and configured to demodulate a power carrier signal modulated and transmitted by the intelligent probing rod 1, perform gain amplification and fidelity on the power carrier signal through the signal relay sub 2, and transmit a modulated downhole instrument control instruction downward through detection data transmitted by the cable drill pipe 3. The industrial notebook computer 41 is connected to the ground modem 42, and configured to extract a digital signal in the power carrier, and record a data flow. The data interpretation and goaf reconstruction imaging software system is provided in the industrial notebook computer 41 to process and analyze the detection data. The remote data transmission system is connected to the ground control terminal 4, such that the site data is read and analyzed by a worker at the cloud server and the remote client to realize remote data management and communication information interaction.

Referring to FIG. 1 to FIG. 5, the data interpretation and goaf reconstruction imaging software system 8 includes an intelligent probing rod built-in acquisition and control application module 81, a platform controller built-in application module 82, a ground industrial control system 83, and a reconstruction imaging software platform 84. The intelligent probing rod built-in acquisition and control application module 81 is provided in the master control circuit board 124 of the instrument cabin of the intelligent probing rod, and configured to receive an instruction from the platform controller built-in application program, control the sensor assembly 123 in the intelligent probing rod 1 to detect the goaf, and upload the detection data to the platform controller built-in application program through the downhole modem 125 via the cable drill pipe 3. The platform controller built-in application module 82 is provided in the ground control terminal 4, and configured to control the ground modem 42 to extract a digital signal from a power system, acquire the detection data from the downhole intelligent probing rod 1, and transmit the data to the industrial notebook computer 41. The ground industrial control system 83 is provided in the ground control terminal 4, and includes an intelligent probing rod control system and internal peeping detection data processing software. The reconstruction imaging software platform 84 is provided in the industrial notebook computer 41, and configured to receive the detection data from the ground industrial control system, and perform 3D modeling and imaging on the underground goaf.

Figure 6:
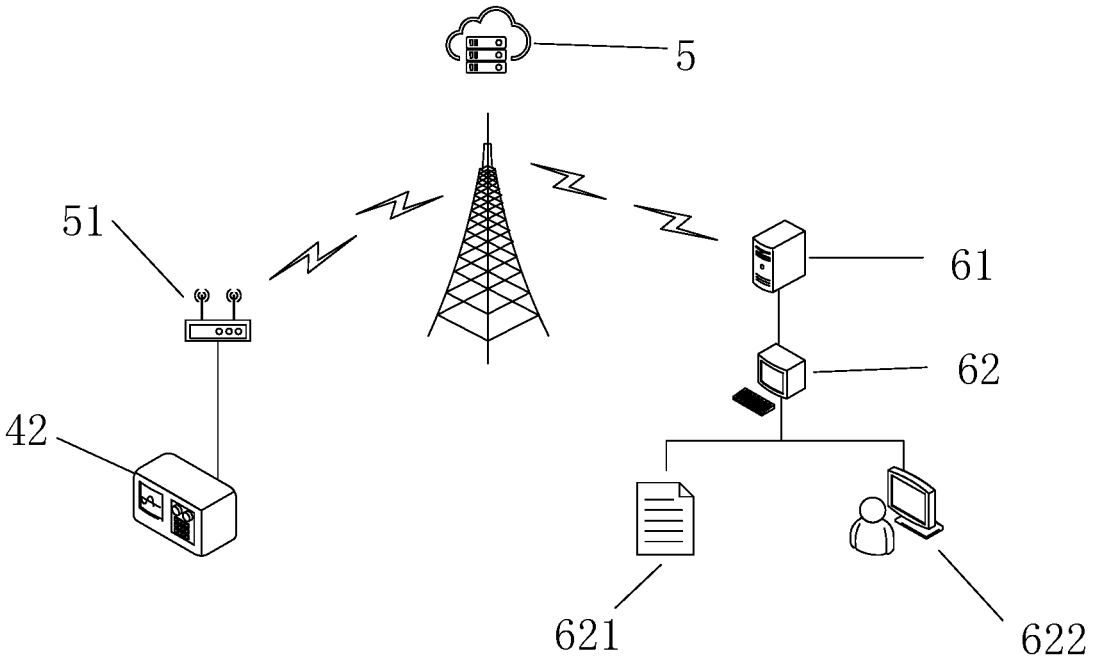
FIG. 6 is a schematic structural view of a remote data transmission system.

Referring to FIG. 6, the remote data transmission system 6 includes an Internet access device 51, a cloud server 5, a remote server 61, a remote client 62, a remote data management module 621, and a communication information interactive platform 622. The Internet access device 51 receives a signal from the ground control terminal 4, and transmits data to the cloud server 5 in various wireless network transmission modes such as wireless fidelity (WiFi) and time division long term evolution (TD-LTE). The remote server 61 can download data from the cloud server 5 in real time, and store the data locally. The remote client 62 can access the remote server 61 at any time for data reading and analysis, and integrates the remote data management module 621 and the communication information interactive platform 622 based on developed system software. The remote data management module 621 realizes real-time data updating, historical data playback, etc.

A detection method of the internal peeping detection-while-drilling system for the deep goaf of the mining-disturbed stratum includes the following steps:

In step S1, a mining-disturbed stratum is drilled. The intelligent probing rod 1 drills to the target goaf. Specifically:

In step S1.1, early preparation is made before the drilling. According to early data, a hole position is located, a drilling scheme is determined, a drilling system is provided, and functions of various parts of the detection system are debugged, thereby completing various early preparations on the drilling.

In step S1.2, based on a high ground stress, a high degree of fragmentation and a complex environment of the mining-disturbed stratum, a pipe-following drilling technology and supported drilling tools are used. The intelligent probing rod is provided with the sealing damped protection mechanism. With the special pipe-following drilling technology, a wall protection problem in a fracture region of a "three-zone" rock stratum on the goaf is resolved, a stable detection channel is provided, and the intelligent probing rod is sent to the goaf.

In step S2, after the intelligent probing rod 1 reaches the goaf, the intelligent probing rod 1 is extended out to expose the instrument cabin, thereby detecting data of the target goaf, storing the data, modulating the data and transmitting the data to the ground control terminal 4, specifically including:

In step S2.1, according to drilling parameters such as a weight on bit (WOB), a rotational speed, a pump volume, a pump pressure and an elevating power, time drilling to the target goaf is determined.

In step S2.2, according to the drilling parameters such as a hole trajectory parameter, a hole depth, a hole drift angle and a drift azimuth, a spatial position of the target goaf is located.

In step S3, data transmission is performed. The sensor assembly modulates the detection data after acquiring the detection data, and transmits the detection data to the ground through the cable drill pipe in the form of the power carrier. The signal relay sub is provided at a certain spacing distance in the transmission channel formed by the cable drill pipes. The signal relay sub performs demodulation, preprocessing, gain amplification and remodulation on the modulated detection data, and transmits remodulated detection data to an upper end continuously. At last, the detection data is transmitted to the ground control terminal through the cable drill pipe and the signal relay sub.

In step S4, the ground control terminal demodulates acquired data, and performs modeling to obtain a 3D structural model of the underground goaf.

Specifically, the ground control terminal demodulates the acquired data: The detection data is transmitted to the ground control terminal through the transmission channel composed of the cable drill pipe and the signal relay sub. The modem of the ground control terminal performs demodulation and conversion on the detection data. Through the ground industrial notebook computer, the data is visualized, stored and uploaded to the ground detection control software platform of the industrial notebook computer, thereby realizing detection control and audio/video communication.

The ground control terminal performs the modeling to obtain the 3D structural model of the underground goaf: Through the ground industrial notebook computer or the remote client, 3D underground goaf modeling and imaging, including image enhancement, laser-sonar 3D joint modeling, and multi-source heterogeneous data 3D joint modeling, are performed on the detection data from the ground industrial control system, thereby obtaining the 3D structural model of the underground goaf.

In step S5, remote Internet data transmission is performed. The ground control terminal transmits the site detection data to the cloud server through the Internet data transmission system. The remote server downloads the data of the cloud server. The remote client accesses the remote server to realize the remote data management and the communication information interaction. Specifically:

In step S5.1, data is accessed to an Internet. The ground control terminal accesses the data to an Internet system through the Internet access device.

In step S5.2, the data is transmitted through the Internet. The Internet access device transmits the data to the cloud server in various wireless network transmission modes such as WiFi and TD-LTE. The cloud server realizes Internet relay storage and communication information forwarding on the detection data.

In step S5.3, remote data management is performed. The remote server downloads cloud data. The remote client accesses the remote server. The remote client with developed system software realizes the data management such as real-time data updating and historical data playback, and remote communication information interaction with the underground site.

In step S6, goaf form evaluation and emergency rescue are performed. A form, an environment and a roof structure of the goaf are evaluated through the underground goaf reconstruction and imaging in Step S4. Life detection on the underground goaf of the rescue site, and ground-underground real-time communication are realized through Step S5.

Herein, the involved orientation terms such as "front", "rear", "upper", and "lower" are defined in terms of the positions of parts and between the parts in the drawings, which are used just for clarity and convenience of expressing the technical solution. It should be understood that the use of such orientation terms should not limit the protection scope claimed by the present disclosure.

The above embodiments and the features of the embodiments herein may be combined with each other without conflict.

The above are merely preferred embodiments of the present disclosure, and are not intended to limit the present disclosure. Any modifications, equivalent replacements, improvements, and the like made within the spirit and principle of the present disclosure shall be all included in the protection scope of the present disclosure.

What is claimed is:

1. An internal peeping detection-while-drilling system for a deep goaf of a mining-disturbed stratum, comprising an intelligent probing rod, cable drill pipes, a signal relay sub, a ground control terminal, a data interpretation and goaf reconstruction imaging software system, and a remote data transmission system, wherein a transmission cable is provided in each of the cable drill pipes; the cable drill pipes are connected to each other from an upper end of the intelligent probing rod to a ground drilling rig to form cable drill pipe assemblies; the cable drill pipe assemblies and the intelligent probing rod are connected sequentially from top to bottom to form a drill pipe assembly; an upper end of the cable drill pipe is connected to the ground drilling rig; and a lower end of the intelligent probing rod is connected to a drilling bit;

the intelligent probing rod comprises an up-down separated protective transmission mechanism and an instrument cabin;

the up-down separated protective transmission mechanism comprises a lower end connected to the drilling bit, and an upper end connected to the cable drill pipe; the instrument cabin is provided in the up-down separated protective transmission mechanism; and the up-down separated protective transmission mechanism is configured to protect the internal instrument cabin in drilling, and extended out to expose the internal instrument cabin after entering a target goaf, so as to facilitate detection of the instrument cabin on the target goaf;

a sensor assembly comprising a sonar sensor, a lidar sensor and an audio and video sensor is provided in the instrument cabin; and the sensor assembly is configured to acquire structural parameters of the underground goaf, photograph the underground goaf and perform borehole-ground communication in an emergency rescue;

the signal relay sub is a special cable drill pipe, and is provided between the cable drill pipe assemblies at a certain spacing distance; the signal relay sub comprises a signal relay and a relay cable; the relay cable comprises an upper end and a lower end respectively connected to adjacent ones of the cable drill pipes, and a middle connected to the signal relay; and the signal relay receives a power carrier signal of the transmission cable in the lower cable drill pipe, performs demodulation, preprocessing, gain amplification, denoising, storage and modulation on the power carrier signal, and transmits the power carrier signal upward to the upper cable drill pipe in a form of a power carrier;

the cable drill pipes are connected to each other to form a power and data transmission channel; the cable drill pipe comprises a lower end connected to the intelligent probing rod, and the upper end connected to the drilling rig; the transmission cable is connected to the ground control terminal; the transmission cable is configured to transmit acquired data of the sensor assembly to the ground control terminal in the form of the power carrier; and the ground control terminal is configured to perform three-dimensional (3D) modeling on the acquired data of the sensor assembly through the data interpretation and goaf reconstruction imaging software system, thereby obtaining a 3D structural model of the underground goaf; and the remote data transmission system is connected to the ground control terminal, and configured to remotely transmit site detection data to a cloud server and a remote client, such that the site data is read and analyzed by a worker at the cloud server and the remote client to realize remote data management and communication information interaction.

2. The internal peeping detection-while-drilling system according to claim 1, wherein the up-down separated protective transmission mechanism comprises a separable upper protective tube and lower protective tube; the intelligent probing rod also comprises an independent rotation control mechanism; the instrument cabin is provided between the upper protective tube and the lower protective tube; the independent rotation control mechanism is provided in the upper protective tube; the independent rotation control mechanism is connected to the instrument cabin; and the independent rotation control mechanism is configured to drive the instrument cabin to rotate, such that the sensor assembly in the instrument cabin detects the underground goaf rotatably to obtain structural data of the underground goaf.

3. The internal peeping detection-while-drilling system according to claim 2, wherein the instrument cabin comprises an instrument cabin rod body; a mounting hole is formed in a sidewall of the instrument cabin rod body; the sensor assembly is embedded into the mounting hole of the instrument cabin rod body; and a protective glass cover plate is further provided on the mounting hole.

4. The internal peeping detection-while-drilling system according to claim 3, wherein the independent rotation control mechanism comprises three step control motors; the three step control motors are fixed in the upper protective tube; a driven tooth is provided at an end of the instrument cabin rod body; the step control motors are engaged with the driven tooth through a driving gear arranged at an end of each of the step control motors; and the three step control motors rotate synchronously, thereby driving the instrument cabin to rotate.

5. The internal peeping detection-while-drilling system according to claim 1, wherein the ground control terminal comprises a ground modem and an industrial notebook computer that are connected sequentially; and the ground modem is connected to the cable drill pipe through a cable, and configured to receive and modulate a control instruction from the industrial notebook computer and demodulate a signal transmitted from the sensor assembly to the ground control terminal; the data interpretation and goaf reconstruction imaging software system is built in the industrial notebook computer; and the industrial notebook computer is configured to extract a signal demodulated by the ground modem and perform modeling on the demodulated signal through the data interpretation and goaf reconstruction imaging software system, thereby obtaining the 3D structural model of the underground goaf.

6. The internal peeping detection-while-drilling system according to claim 1, further comprising an Internet access device, the cloud server, a remote server, and a remote client, wherein the Internet access device is connected to the ground control terminal, and configured to receive a signal from the ground control terminal, and transmit data to the cloud server; the remote server is configured to download data in real time from the cloud server, and store the data locally; and the remote client is configured to access the remote server, and read and analyze data, thereby realizing data updating and historical data playback.

7. The internal peeping detection-while-drilling system according to claim 1, wherein the cable drill pipe comprises a plurality of sections; the signal relay sub is provided between the cable drill pipes; the signal relay and the relay cable are provided in the signal relay sub; the relay cable is connected to the transmission cable in the cable drill pipe; and the signal relay is configured to receive the carrier signal from the lower cable drill pipe, perform the demodulation, the data preprocessing, the gain amplification and the modulation on the carrier signal, and transmit processed data to the upper cable drill pipe.

* * * * *